US010648696B2

(12) United States Patent
Milfeldt

(10) Patent No.: US 10,648,696 B2
(45) Date of Patent: May 12, 2020

(54) HEATING APPARATUS FOR ARRANGING UNDER A TABLE

(71) Applicant: KSS MADE HOLDING, Copenhagen (DK)

(72) Inventor: Stig Bloch Milfeldt, Arhus C (DK)

(73) Assignee: KSS MADE HOLDING, Koebenhavn K (DK)

( * ) Notice: Subject to any disclaimer, the term of this patent is extended or adjusted under 35 U.S.C. 154(b) by 625 days.

(21) Appl. No.: 15/223,760

(22) Filed: Jul. 29, 2016

(65) Prior Publication Data

US 2017/0115029 A1 Apr. 27, 2017

Related U.S. Application Data

(63) Continuation of application No. 13/256,821, filed as application No. PCT/DK2010/000033 on Mar. 16, 2010, now abandoned.

(30) Foreign Application Priority Data

Mar. 20, 2009 (DK) ..... PA 2009 00387
Jun. 23, 2009 (DK) ..... PA 2009 00773

(51) Int. Cl.
*F24H 3/00* (2006.01)
*A47B 31/02* (2006.01)
(Continued)

(52) U.S. Cl.
CPC ..... *F24H 3/002* (2013.01); *A47B 13/023* (2013.01); *A47B 31/02* (2013.01); *F24C 1/10* (2013.01);
(Continued)

(58) Field of Classification Search
CPC ..... F24H 7/04; F24H 3/002; A47B 13/023; A47B 2200/008; A47B 31/02; F24C 15/22; F24C 1/10; F24C 7/043
(Continued)

(56) References Cited

U.S. PATENT DOCUMENTS 4,900,898 A * 2/1990 Kling ..... F24H 3/0405 392/503
5,805,767 A * 9/1998 Jouas ..... G05D 23/1902 219/506
(Continued)

FOREIGN PATENT DOCUMENTS

DE 19605266 * 8/1997

*Primary Examiner* — Dana Ross
*Assistant Examiner* — Joseph W Iskra
(74) *Attorney, Agent, or Firm* — Cantor Colburn LLP

(57) ABSTRACT

The invention relates to an electrical heating apparatus for arranging under a table, the heating apparatus comprising a housing, at least one electrically powered heat source arranged inside said housing, and heat shielding means comprised in the housing and having a plurality of through holes configured for allowing heat radiation from the electrically powered heat source to pass, wherein the heat shielding means comprises a layer of a material with a thermal conductivity lower than 2 [$W \cdot m^{-1} \cdot K^{-1}$], and wherein the inner surface of the heat shielding means is applied with a layer of heat radiation reflecting material configured for reflecting the heat radiated from the heat source back against the inner part of the housing.

17 Claims, 11 Drawing Sheets

(51) Int. Cl.

| | |
|---|---|
| ***F24C 1/10*** | (2006.01) |
| ***F24C 7/04*** | (2006.01) |
| ***F24C 15/22*** | (2006.01) |
| ***A47B 13/02*** | (2006.01) |

(52) U.S. Cl.
CPC ..... *F24C 7/043* (2013.01); *F24C 15/22* (2013.01); *A47B 2200/008* (2013.01)

(58) Field of Classification Search
USPC ..... 219/354, 365, 377, 369, 339, 366, 368, 219/382, 374, 341, 367, 370, 373, 378, 219/359
See application file for complete search history.

(56) References Cited

U.S. PATENT DOCUMENTS

| | | | | |
|---|---|---|---|---|
| 5,875,013 | A * | 2/1999 | Hiroshi | G02F 1/1335 349/110 |
| 7,170,035 | B2 * | 1/2007 | Peterson | B25H 3/02 206/373 |
| 2005/0213233 | A1 * | 9/2005 | Bezzel | E06B 9/24 359/893 |

* cited by examiner

| Temperature | Time since heat sorce ON | Power |
|---|---|---|
| 13 [deg C] | 1 min. | 100% |
| 13 [deg C] | 5 min. | 70% |
| 12 [deg C] | 10 min. | 80% |
| 18 [deg C] | 15 min. | 40% |

HEATING APPARATUS FOR ARRANGING UNDER A TABLE

CROSS REFERENCE TO RELATED APPLICATIONS

This is a continuation of U.S. patent application Ser. No. 13/256,821, filed on Dec. 19, 2011, which claims priority to International Application No. PCT/DK2010/000033, filed on Mar. 16, 2010. All of said applications are herein incorporated by reference in their entirety.

BACKGROUND

Heating apparatuses for comfort purposes are well known, e.g. in the restaurant business and in relation to outside occasions in cold weather in general, to ensure that persons can sit or stand outside and e.g. dine without getting cold. Therefore, heating apparatuses using e.g. gas for heating are commonly known since they are cheap to acquire. However, due to the large energy consumption and low coefficient of utilization of such natural gas driven heaters, these are environmentally unfriendly and expensive in operation. Further, common natural gas driven heaters often have their heat source arranged 2-3 meters above ground to facilitate heating of a larger area, e.g. an area around one or more tables. This is not advantageous since it is often the lower part of the body that gets cold and needs heating, e.g. when sitting around a table, and since it reduces the coefficient of utilization.

US patent application 2007/0267399 deals with this problem by arranging an electrical or a gas driven heater underneath a table. This invention however, has large energy consumption, and it gets too hot so that persons arranged around the table can get burned when touching the gas driven heater.

Japanese patent document JP61076826 relates to a heater comprising a guard made of a material of high thermal conductivity such as copper, to assure that a thermistor attached to the heater can detect heating of the guard and turn off the heat source fast if the guard gets too hot. The inner surface of the guard comprises a heat reflecting material to achieve a lower outer surface temperature of the guard. This invention suffers from the disadvantage that the heat source can still heat up the heat conducting guard, making the control of the heat source necessary, and making the heater rather unreliable.

SUMMARY

The invention relates to an electrical heating apparatus for arranging under a table, said heating apparatus comprising:
a housing,
at least one electrically powered heat source arranged inside said housing, and
heat shielding means comprised in the housing and having a plurality of through holes configured for allowing heat radiation from the electrically powered heat source to pass, wherein the heat shielding means comprises a layer of a material with a thermal conductivity lower than 2 [$W \cdot m^{-1} \cdot K^{-1}$], and
wherein the inner surface of the heat shielding means is applied with a layer of heat radiation reflecting material configured for reflecting the heat radiated from the heat source back against the inner part of the housing.

Caused by the low thermal conductivity of the heat shielding means and since the heat shielding means comprises a heat radiation reflecting material, the outer surface of the heat shielding means is prevented from being heated, and at the same time the heat reflected from the inner surface is not wasted but can be emitted from the heating apparatus at another location of the heating apparatus, thereby increasing the coefficient of utilization of the heating apparatus and facilitating reduction of the power consumption of the heating apparatus. Further, the low thermal conductivity and the heat radiation reflecting material in a reliable way further prevents the heat shielding means from getting too hot to be touched by human skin, and that clothing, plastic bags and other material arranged near to or even touching the heating apparatus is not heated above their melting point. Likewise, it is possible to use less energy for heating, since the electrical heating apparatus may be arranged near the persons to be heated.

In an aspect of the invention the housing comprises the layer of material with low thermal conductivity, the plurality of through holes and the layer of reflecting material as explained above, whereby the heat shielding means may be an integrated part of the housing.

It is in general understood, that the heat shielding means preferably are arranged so that the heat radiation generated by the heat source leaves through the trough holes of the heat shielding means through a substantially vertical plane. Preferably the heat shielding means are arranged substantially vertically in vertically arranged walls of the housing.

In a preferred aspect of the invention, said housing is configured for preventing heat radiation through the housing at one or more angular sections around a vertical axis.

Hereby, it is possible to avoid emission of heat from at least some predetermined directions/areas. This facilitates that a person can place a bag, e.g. with foodstuffs or other heat sensitive objects against the heating apparatus without the foodstuffs being unintentionally heated. Further, this may increase the coefficient of utilization since the heat is only emitted from the heating apparatus from one or more predetermined angular sections, (i.e. from the through holes of the heat shielding means), and radiation heat not emitted towards these sections from the inner part of the heating apparatus may be reflected, e.g. by one or more inner heat radiation reflecting screens (described later on) towards/back towards the heat shielding means.

In an aspect of the invention, the electrical heating apparatus further comprises one or more inner heat radiation reflecting screens arranged inside said housing and being configured for reflecting heat radiation towards the heat shielding means.

Hereby, the coefficient of utilization of the heater may further be increased since the heat reflected towards the heat shielding means may be focused at the heat shielding means. Further, the inner heat reflecting screen(s) may be advantageous if the heating apparatus is configured for preventing heat emission from the heating apparatus in one or more angular directions around a vertical axis of the electrical heating apparatus, since the heat may be reflected back towards the heat shielding means by the inner heat reflecting screen(s), and the inner heat radiation reflecting screen(s) may hereby act as both a reflector and as a shield for preventing the heat from being emitted from unintended areas.

In an aspect of the invention, the electrical heating apparatus is configured for allowing heat emission from two predetermined angular sections of the heating apparatus, the two angular sections being substantial opposite to each other in the housing.

The prevention of heat emission from the electrical heating apparatus in only two directions facilitates that persons sitting opposite to each other can be heated. The heating apparatus in this aspect comprises one or more heat shielding means arranged at each of the angular sections allowed for heat emission, thereby facilitating heat emission through the through holes of the heat shielding means. The heat may preferably be emitted from at least two predetermined angular sections substantial opposite to each other as explained above, but it may also in other aspects of the invention be emitted at three, four or more predetermined angular sections.

In an aspect of the invention, the at least one electrically powered heat source is of a rated power between 100 W and 700 W such as between 150 and 500 W, most preferred between 250 and 400 W, such as about 300 W. Likewise, 400 W may be a preferred rated power for the heat source.

Due to the heat radiation reflecting material and the layer of a material with low thermal conductivity, it is possible to keep the rated power of the electrically powered heat source low and still facilitating sufficient heating of nearby persons, thereby saving energy.

In an aspect of the invention, said layer of a material with a thermal conductivity lower than 2 [$W \cdot m^{-1} \cdot K^{-1}$] has a thermal conductivity lower than 0.5 [$W \cdot m^{-1} \cdot K^{-1}$], preferably lower than 0.2 [$W \cdot m^{-1} \cdot K^{-1}$]. Hereby, heating of the heat shielding means is further prevented.

In an aspect of the invention, said electrical heating apparatus comprises power connection means configured for power supply of one or more further heating apparatuses.

Hereby, it is possible to reduce the number of wires for supplying electrical heating apparatus, since one heating apparatus may be supplied from another heating apparatus. The power connection means preferably comprises a socket adapted to receive a plug on electrical supply means such as a wire.

In an aspect of the invention, said electrical heating apparatus facilitates support of a table top.

This facilitates that persons arranged around a table may be heated by the heating apparatus, and at the same time space is saved since the heating apparatus is an integrated part of the table. Further, it facilitates that the heating apparatus may be implemented underneath small tables, since no extra space has to be reserved for the heating apparatus. The heating apparatus may be arranged substantially at the centre of a table top, facilitating even heat distribution towards predetermined areas of the table.

In an aspect of the invention, said electrical heating apparatus is configured for being attached to the undersurface of a table top without touching the ground.

Hereby, it is achieved that the heating apparatus facilitates the heating of persons around the table, and at the same time the heating apparatus does not take up space for the legs.

In an aspect of the invention, said electrical heating apparatus comprises sensor means configured for detecting the presence of one or more persons around the heating apparatus, and control means configured for controlling the heat source based on signals from said sensor means.

Hereby, it is achieved that the heating apparatus may automatically be turned on when persons are detected, which saves energy. In other aspects of the invention, the heating apparatus may comprise timer means, temperature measuring means, other means such as a button for controlling the heating apparatus/the heat source, combinations thereof or the like.

In an aspect of the invention, said heating apparatus comprises data processing means for controlling the electrically powered heat source, wherein the data processing means facilitates regulation of the at least one electrically powered heat source to a value below its rated power.

The data processing means may be adapted for controlling the heat source based on data from sensor means, timer means, temperature, time of the day etc. to achieve advantageous and energy saving control of the heating apparatus, and it is possible to adapt the heating apparatus to emit the wanted/necessary amount of heat.

It is understood that the data processing means may facilitate an on/off function of the heat source, e.g. based on input from a sensor and/or a timer.

In an aspect of the invention, the data processing means may automatically control the electrically powered heat source to a value below its rated power, based on input data such as the temperature, the time of the day, the time since the heat source was turned on or the like. This may increase the comfort when persons are placed around the heating apparatus, and at the same time it can save energy.

In an aspect of the invention, said heat shielding means, during operation, will not be heated to a temperature above 60° C. such as not above 50° C., e.g. not above 40° C.

Hereby, it is achieved that persons and/or clothing touching the heating apparatus does not get burned or damaged. It is understood that the temperatures mentioned above may be achieved during operation in ordinary operation environment, e.g. in temperatures of the ambient air ranging from 8° C. to 18° C. and 2-5 m/s wind speed. Lower (or higher) temperatures may be present at other ambient temperatures and wind speeds.

Preferably, the heating apparatus should be utilized at a temperature of the ambient air below 25° C. such as below 20° C.

In an aspect of the invention, said housing has a diameter of no more than 0.5 meters, such as no more than 0.3 meters, e.g., no more than 0.16 meters.

Hereby, it is achieved that the heating apparatus does not take up much space underneath the table, and allows more room for persons' legs and feet.

In an aspect of the invention, said layer of heat radiation reflecting material has a reflection coefficient $\rho$ of infrared radiation in the range of 0.6 to 1, preferably in the range of 0.8 to 1 such as between 0.85 and 1, in order to achieve as much reflection of the infrared radiation striking the reflecting layer, as possible.

In an aspect of the invention, said housing and said heat shielding means together form a substantially circular shaped heating apparatus seen from above.

Hereby, the heating apparatus is space saving and at the same time may emit heat over a larger area.

In a further aspect of the invention, the heating apparatus is adapted to facilitate a flow of air from the outside of the housing, through one or more inlets into the housing, through the inside of the housing, and out through one or more outlets of the housing. Hereby cooling of the housing is achieved which is advantageous if the housing gets heated e.g. by absorbing some of the heat radiated from the heat source, and/or by waste heat generated by the heat source.

In an aspect of the invention, the inlet(s) and outlet(s) are arranged to facilitate that the flow of air is driven by a stack effect.

By the term "stack effect" also known as the chimney effect, is to be understood that a flow of air is automatically generated by a pressure difference between the air outside the housing and the air inside the housing, caused by the difference in temperature between the air outside the housing and the air inside the housing.

By using the stack effect, also known as "chimney effect" in the heating apparatus to cause a flow of air to cool the housing, a cost efficient and energy saving cooling of the housing is possible. In another aspect of the invention, the flow of air inside the housing is generated at least partly by other means suitable to achieve a flow as explained above, e.g. by means of a ventilator.

In an aspect of the invention, the above mentioned outlet(s) are arranged at the upper part of the heating apparatus.

Since heat generally seeks upward, it is advantageous to arrange the outlet(s) at the upper part of the heating apparatus.

In an aspect of the invention, the mentioned inlet(s) and/or outlet(s) comprises one or more through holes in the side of the housing.

Hereby, a way to control in which direction the waste heat is let out may be achieved, e.g. to facilitate that the waste heat is let out substantially over the shielding means to assure that the waste heat may help to heat people arranged around the heating apparatus (preferably sitting/standing opposite to the shielding means to get heated by the heat radiation).

In an aspect of the invention, the mentioned inlet(s) are the plurality of through holes of the heat shielding means.

Hereby, the heat shielding means are automatically cooled by the flow of air, since the through holes of the heat shielding means are used as inlet(s).

BRIEF DESCRIPTION OF THE DRAWINGS

Embodiments of the invention will be described in the following with reference to the enclosed drawings of which.

DETAILED DESCRIPTION OF THE DRAWINGS

Figure 1:
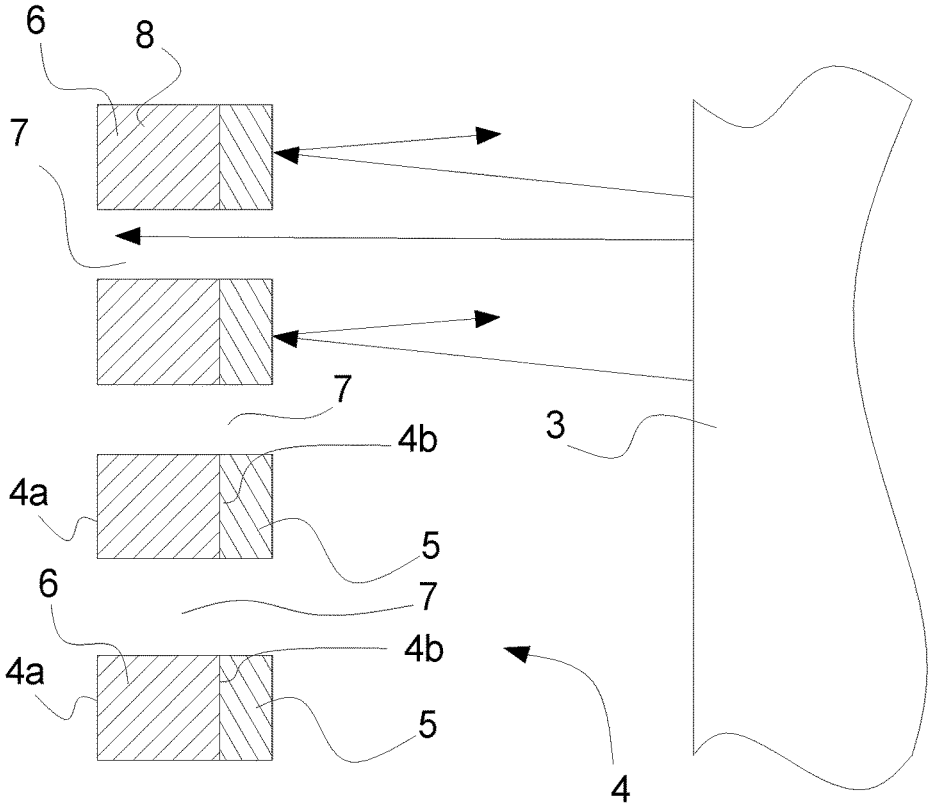
FIG. 1 illustrates a cross-sectional view of a part of a heating apparatus according to the invention.

FIG. 1 illustrates a part of the heating apparatus 1 according to the invention. The heating apparatus 1 comprises an electrically powered heat source 3 arranged inside a housing 2 (not illustrated in FIG. 1). The heating apparatus 1 further comprises heat shielding means 4 comprising a plurality of through holes 7, an outer surface 4*a* facing the surroundings of the heating apparatus 1, and an inner surface 4*b* facing the inner part of the heating apparatus 1. The shielding means 4 comprises at least one layer 6 of material with a low thermal conductivity of no more than 2 [$W \cdot m^{-1} \cdot K^{-1}$], such as no more than 0.5 [$W \cdot m^{-1} \cdot K^{-1}$], e.g. no more than 0.2 [$W \cdot m^{-1} \cdot K^{-1}$]. Such material may preferably be a polymer such as (but not in any way limited to) polyethylene, polypropylene, Polycarbonate (PC), polyoxymethylene (POM), Acrylonitrile Butadiene Styrene (ABS), a silicone material or the like. Especially polypropylene, polycarbonate and ABS materials are advantageous since these materials are easy to chrome (e.g. by electroplating) to comprise a heat radiation reflecting material 5 as described in more details later on.

However, it may also be other materials such as wood, a glass material, a cement material or other suitable materials with low thermal heat conductivity. Likewise, the layer 6 of a material with a low thermal conductivity may be of any combination of the above mentioned materials.

The electrically powered heat source 3 is preferably an infrared heat source for emitting infrared radiation between 700 nm and 3000 nm. The infrared heat source may e.g. be a short wave (also known as near infrared) heat source such as a quartz shortwave infrared heat source emitting infrared radiation in the range from around 700 nm to 1400 nm. These infrared heat sources emit at least some visible light. Other infrared heat sources 3 may be medium infrared heat sources emitting radiation in the range between 1400 nm and 3000 nm or far-infrared or dark emitters for emitting infrared radiation above 3000 nm. Likewise, heat sources such as an incandescent lamp or any other suitable heat source 3 at least emitting infrared radiation may be used as the electrically powered heat source 3.

The above mentioned emission between 700 nm to 1400 nm, 1400 nm and 3000 and/or above 3000 nm are understood to be examples of primary operating ranges of the infrared heat source 3. The heat source may also emit radiation within other wavelength areas outside the primary operating ranges, e.g. at other infrared wavelengths and/or wavelengths visible to the human eye such as from 400-700 nm.

The color temperature of the infrared heat source may during operation in a preferred embodiment be within 1500° K to 3000° K such as within 2200° K to 2600° K.

The electrically powered heat source 3 may be of a rated power between 75 W and 700 W such as between 150 W and 500 W, most preferred between 250 W and 400 W such as about 300 W. Another example may be between 250-500 W such as about 400 W.

Likewise, the length of the heat source 3 may be between 0.1 m and 0.7 m, such as between 0.2 m and 0.4 m, for example about 0.25 m long, and may be substantial vertically extending inside the housing 2.

The heat source 3 may furthermore advantageously comprise a reflective coating for improving efficiency.

The heat shielding means 4 further comprises a layer of heat radiation reflecting material 5 applied on the inner surface 4*b* of the shielding means, in this case on the inner surface 6*b* of the layer 6 with a low thermal conductivity. This heat radiation reflecting material 5 further prevents the shielding means 4 from getting heated, by reflecting the heat radiation which does not pass through the through holes 7 back towards the inner part of the heating apparatus 1 to be emitted at another location of the heating apparatus 1, thereby also increasing the coefficient of utilization of the heating apparatus 1. The through holes 7 may be horizontally extending oblong through holes, it may be a plurality of circular, round, hexagonal, pentagonal and/or triangular through holes, it may be vertically extending oblong through holes 7 combinations of these or any other suitable through holes 7 suitable for allowing infrared radiation to pass.

The equation for thermal opaque solid surfaces may be described as $\rho+\alpha=1$ where $\rho$ is the coefficient of total reflectivity and a is the coefficient of total absorptivity. It is preferred that the heat radiation reflecting material 5 has a reflection coefficient $\rho$ of infrared radiation in the range of 0.6 to 1, preferably in the range of 0.8 to 1 such as between 0.85 and 1.

The heat radiation reflecting material 5 may e.g. be a chrome material, or it may be any other suitable material for reflecting the heat radiation.

The layer of heat radiation reflecting material 5 may e.g. be applied to the surface by evaporation, which is an advantageous method for applying a thin layer of material. If the reflecting layer is applied by evaporation, the reflecting layer may also be applied on the outer surface (not illustrated in any drawing) of the shielding means since this eases the manufacturing of the heat shielding means. However, this reflecting layer 5 at the outer surface of the shielding means 4 would have a negligible influence on the temperature of the outer surface, since the layer applied by evaporation is very thin.

It is, however, understood that any other suitable method for applying the heat radiation reflecting material 5 may be used, e.g. by spraying means, by lowering the shielding means 4 into fluid heat radiation reflecting material 5 temporarily kept in a fluid state, or the like.

In a preferred embodiment, the layer 6 with low thermal conductivity forms the outer part of the heat shielding means 4 and at the same time acts as the support layer 8 of the shielding means 4. The layer 6 with low thermal conductivity may in this embodiment be of a thickness 0.3 cm and 5 cm, such as between 0.5 and 3 cm, e.g. between 0.8 and 2.5 cm, to facilitate the supporting function of the support layer.

By the term support layer 8 is to be understood a layer which facilitates a strengthening function to achieve a mechanical protection against outer physical forces and to keep the form/structure of the shielding means 4.

Figure 1A:
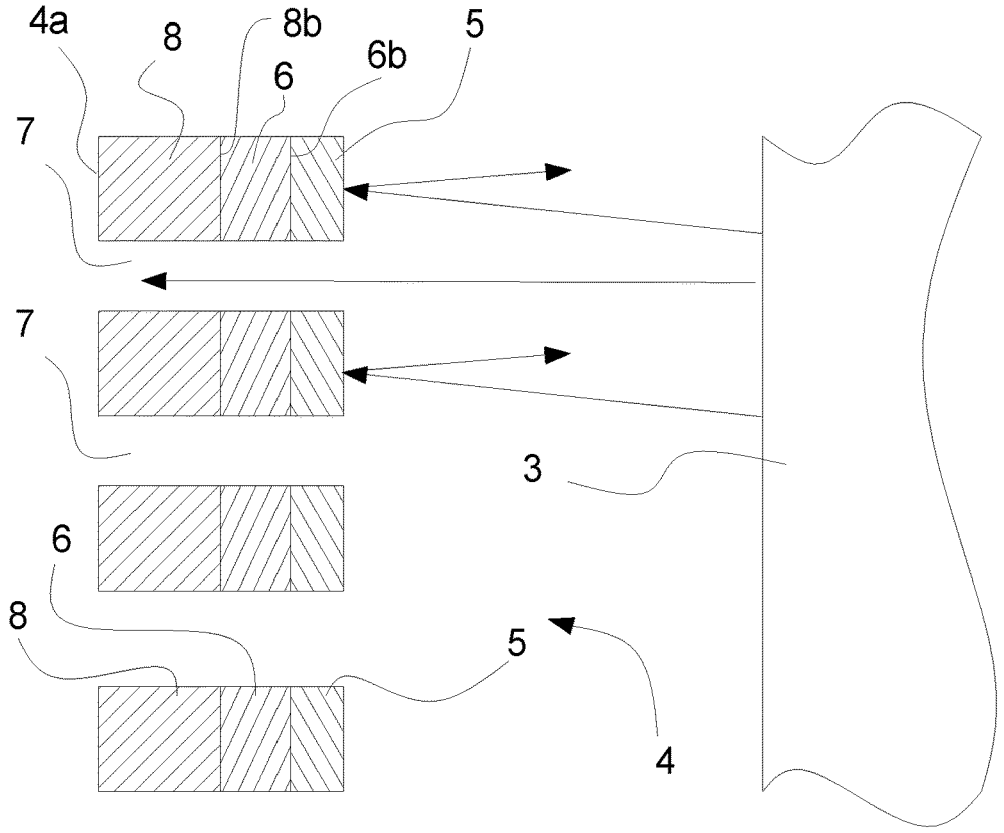
FIGS. 1*a*-1*c* illustrate cross-sectional views of a part of the heating apparatus according to the invention.

FIG. 1*a* illustrates another embodiment of the invention comprising a third layer being a support layer 8. The support layer 8 is in this embodiment applied on its inner surface 8*b* with the layer 6 of material with a low thermal conductivity as described above, followed by a heat radiation reflecting material 5 applied on the inner surface 6*b* of the layer 6 with a low thermal conductivity. Since the support layer 8 in the embodiment of FIG. 1*a* is the outmost layer of the shielding means 4 it is advantageous if the support layer 8 is made of a weather resistant material such as e.g. stainless steel, galvanized steel, fibreglass, aluminium, carbon fibre, a polymer such as a plastic material or the like, which also are (or may be arranged to be) strong materials to protect against outer physical forces. This support layer 8 will substantially not be heated by the heat source 3 due to the layer 6 of material with a low thermal conductivity and the heat radiation reflecting layer 5, thereby keeping the outer surface 4*a* of the heat shielding means 4 at a low temperature.

Figure 1B:
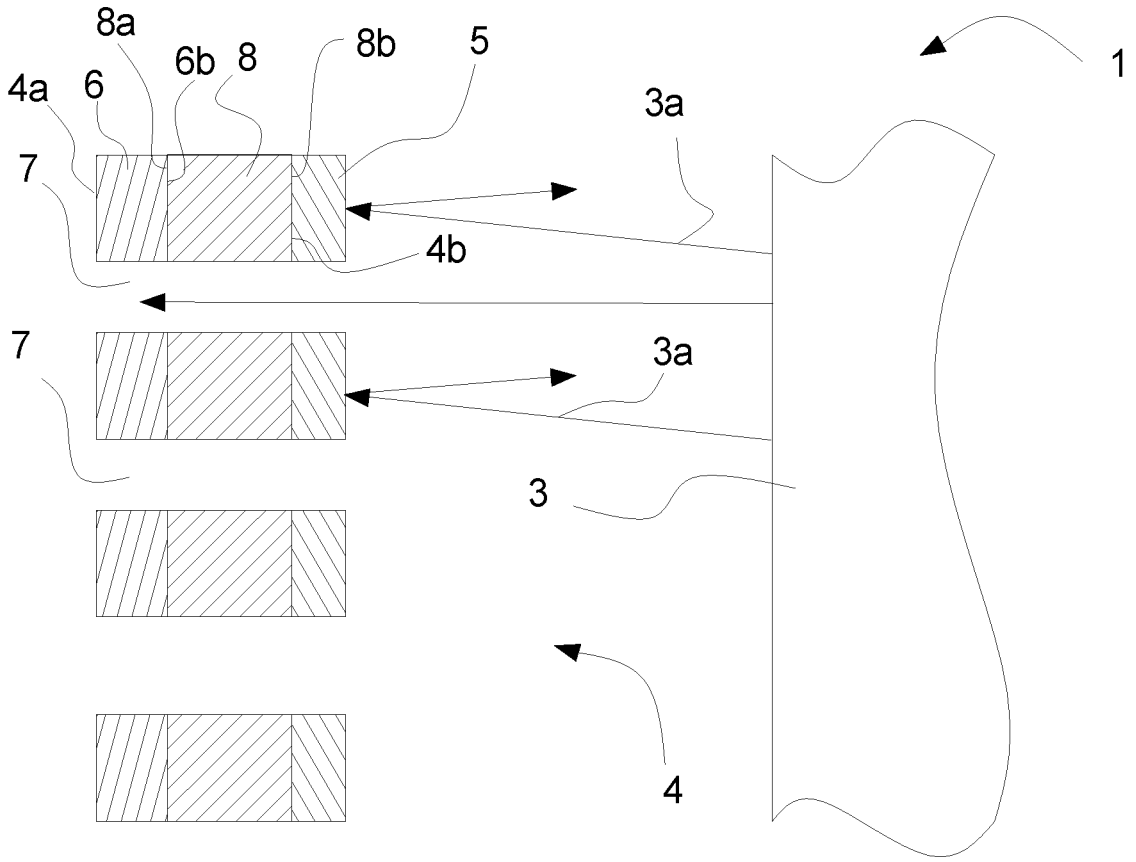

FIG. 1*b* illustrates a further embodiment of the invention. In this embodiment the layer 6 of material with a low thermal conductivity is the outmost layer and is applied at the outer surface 8*a* of the support layer 8, i.e. the inner surface 6*b* of the layer 6 with low thermal conductivity faces the outer surface 8*a* of the support layer 8. The radiation heat reflecting layer 5 is applied at the inner surface 8*b* of the support layer 8. Thereby, it is possible to use a cost efficient material as support layer 8, e.g. iron, aluminium, a strong polymer material, a composite material or the like, since the layer 6 with low thermal conductivity is the outmost layer. Further, the reflecting layer 5 reflects the heat which does not pass through the perforations of the shielding means 4, further keeping the outer surface 4*a* of the shielding means 4 low together with the layer 6 of material with a low thermal conductivity.

Figure 1C:
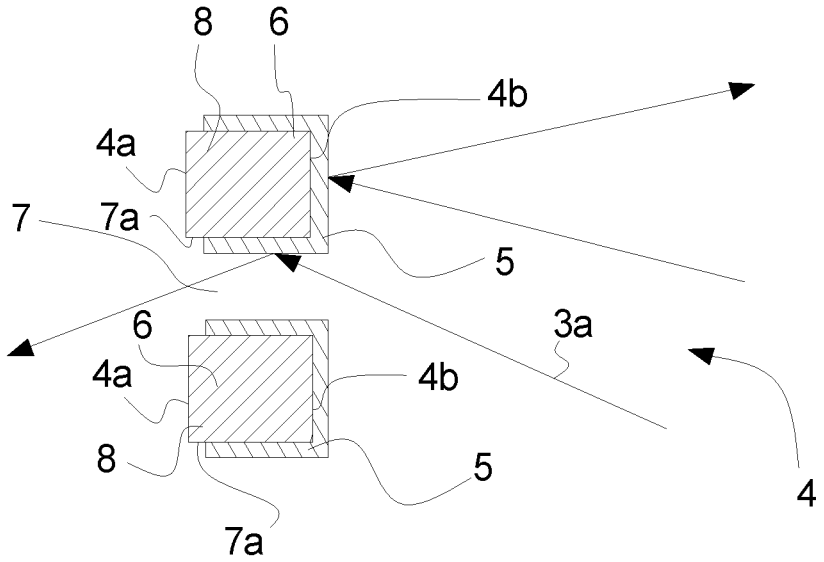

FIG. 1*c* illustrates an embodiment of the invention where the inner surfaces 7*a* of the through holes 7 are also applied with the reflecting layer 5 like the inner surface 4*a* of the heat shielding means 4. This facilitates that heat radiation 3*a* striking the inner surfaces of the through holes 7 of the layer 6 of a material with low thermal conductivity and/or the support layer 8 if such a layer is present will also be reflected. Hereby, enhanced reflection form the heat shielding means 4 may be achieved, and heating of the layer 6 of a material with low thermal conductivity and/or the support layer 8 if such a layer is present may be further decreased.

In an embodiment of the invention the heat shielding means 4 may comprise one or more inner angular surfaces (not illustrated) comprising the reflecting layer 5, and facing the inside of the housing 2. These one or more inner angular surfaces may be achieved by arranging the inner surfaces 7*a* of the through holes 7 in an angle compared to the horizontal plane, and inclining from the inner surface of the heat shielding means 4, towards the outer surface of the heat shielding means 4. Hereby, it may be possible to increase scattering of the heat radiation (which may be desirable in some situations) emitted from the heating apparatus 1 and/or to further adapt the direction of the heat radiation emitted from the heating apparatus 1, e.g. to increase heat emitted towards the feet of persons arranged around the heating apparatus.

Figure 2:
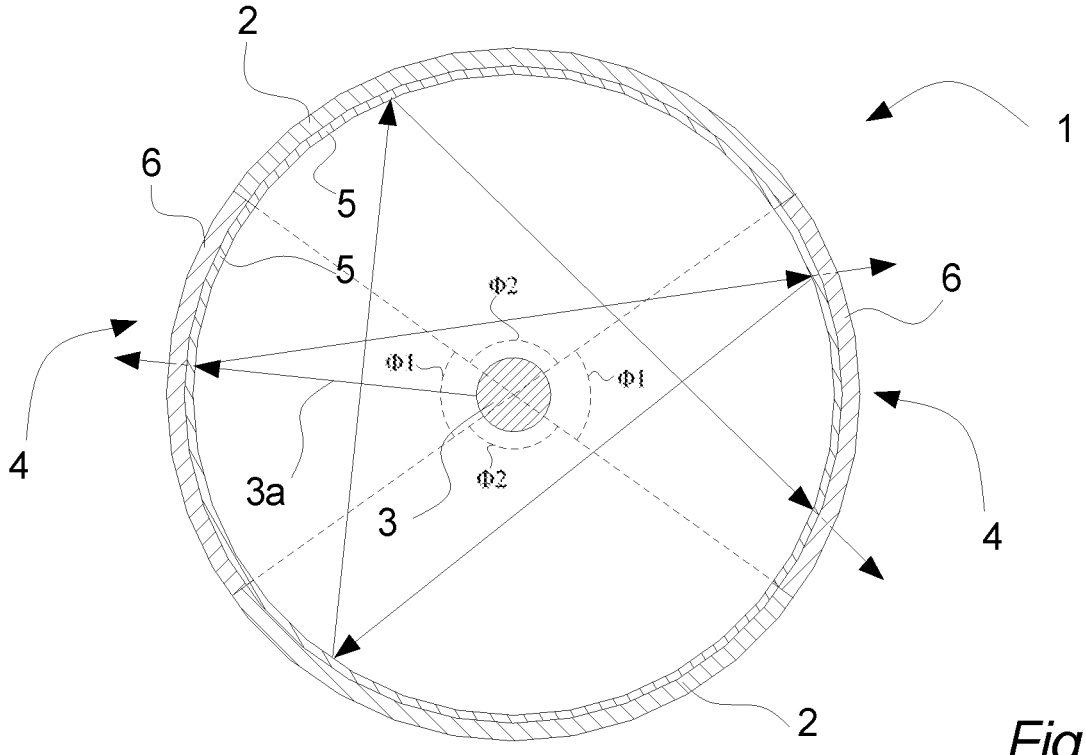
FIG. 2 illustrates a cross-sectional view of the heating apparatus seen from above.

FIG. 2 illustrates an embodiment of the heating apparatus 1, and is a cross-sectional view of the heating apparatus 1 seen from the top, where the heating apparatus 1 comprises two heat shielding means 4, thereby allowing heat emitted from the heating apparatus 1 to be emitted from two different angular sections around a vertical axis of the heating apparatus 1, while the housing 2 prevents heat emission from other areas of the heating apparatus 1. It is preferred that the two heat shielding means 4 are arranged substantially opposite to each other to allow heat emission in opposite direction(s). This is advantageous if the heating apparatus 1 is arranged underneath a table top 9, since the lower body part (legs, feet, lower part of torso etc.) of persons arranged opposite to each other may hereby be heated. However, it is understood that the heating apparatus 1 may in other embodiments be adapted to emit heat in 1, 3, 4 or more predetermined directions around a vertical axis of the heating apparatus 1, e.g. as explained later on in connection to FIGS. 3 and 3*a*.

It is understood that the inner surface of the housing 2 which in this embodiment may be exposed to the heat radiation 3*a* from the heat source 3 may also like the shielding means 4 comprise a heat radiation reflecting layer 5 as illustrated in FIG. 2.

It is of cause understood that the housing 2 like the heat shielding means 4 may comprise a layer of low thermal conductivity (or may be made of such material) such as polyethylene, polypropylene, polycarbonate (PC), polyoxymethylene (POM), a silicone material, wood, a glass material, Acrylonitrile Butadiene Styrene (ABS), or any combination there off, and that this/these material(s) may also comprise a supporting function to keep the structure/form of the housing 2. Likewise some of these materials are (as mentioned earlier) especially advantageous if the housing 2 is covered on its inner surface to comprise a heat radiation reflecting material 5. Other materials may e.g. be aluminum, cast iron or the like which however in some situations are disadvantageous in that they may be heated to a unwanted temperature due to their thermal conductivity.

Figure 3:
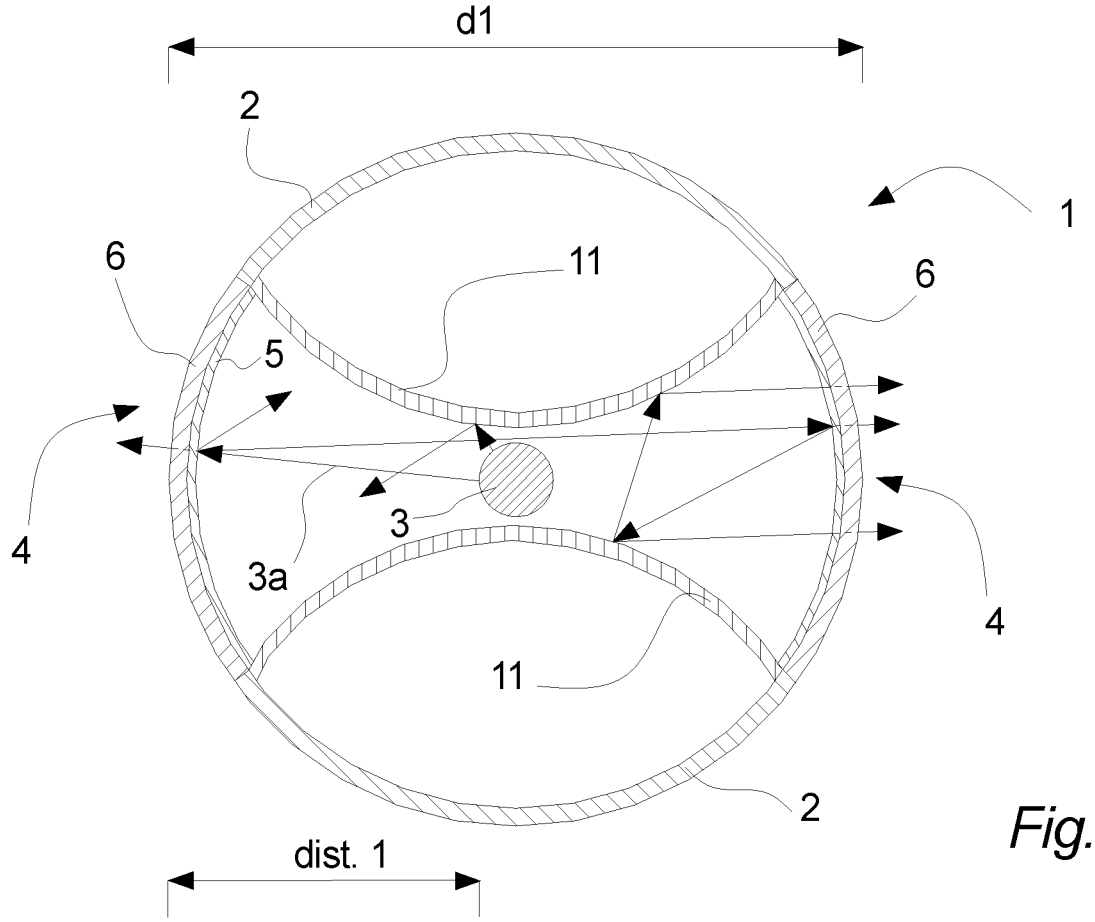
FIGS. 3 and 3*a* illustrate cross-sectional views of the heating apparatus seen from above comprising inner heat radiation reflecting means.
Figure 3A:
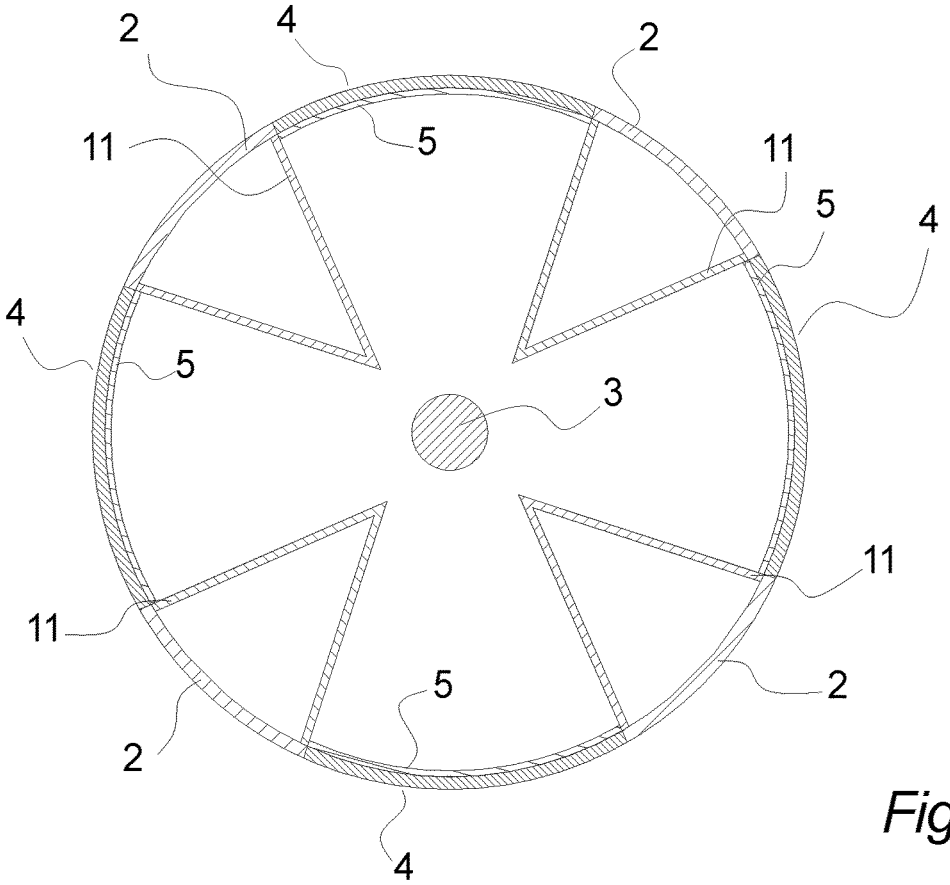

It is preferred that the housing 2 (e.g. together with the heat shielding means 4) forms a substantially circular shaped heating apparatus 1 as illustrated e.g. in FIGS. 2, 3 and 3*a*. Hereby, the heating apparatus is space saving and at the same time may emit heat over a larger area. However, the heating apparatus 1 may also in other embodiments take other forms, e.g. rectangular shapes, oblong shapes, pentagonal shapes, hexagonal shapes, other shapes or the like. Likewise, the heat shielding means 4 may have a curved form e.g. curving outwardly from the heating apparatus 1.

FIG. 2 further illustrates an example of an angular section Φ1 allowing heat radiation from the heating apparatus 1, and an angular section Φ2 of the heating apparatus preventing heat radiation from the heating apparatus 1. The angular sections Φ1, Φ2 may e.g. be between 45°-120° such as between 60°-100°. As an example, if the housing 2 prevents heat radiation at two 100° angular sections Φ2 e.g. arranged substantially opposite to each other, heat radiation may be emitted by means of the heat shielding means at two other 80° angular sections Φ1.

The walls of the housing 2 of the heating apparatus 1 and the heat shielding means 4 are as illustrated in several figures preferably substantially vertically arranged. Thereby, the heat radiation 3*a* leaves the housing 2 of the heating apparatus 1 through the through holes 7 of the heat shielding means 4 horizontally and/or in an angle in relation to horizontal, through a substantially vertical plane. This is also illustrated in the FIGS. 4 and 8-12*c*, illustrating different embodiments of the heating apparatus 1.

FIG. 3 illustrates a preferred embodiment of the invention wherein the heating apparatus 1 comprises inner heat radiation reflecting screen(s) 11, also referred to in the following as inner reflecting screens 11 or inner reflector(s) 11.

The inner reflecting screen(s) 11 facilitates that the coefficient of utilisation of the heating apparatus 1 is further increased, since the inner reflector(s) 11 can focus the reflected heat from the heat source 3 or from the heat shielding means towards the shielding means 4. It is understood that the layout of the inner heat radiation reflecting screen(s) 11 may take any suitable form to achieve advantageous focusing of the reflected heat radiation towards the shielding means 4, e.g. convex forms, concave forms, plane surfaces arranged in advantageous angles, combinations thereof and/or the like. The inner reflector(s) 11 preferably comprise a material with low thermal conductivity, applied with a layer of reflecting material as the reflecting material applied to the heat shielding means 4, to increase the coefficient of utilization. However, the inner reflector(s) may also in other embodiments be made of reflecting material which may have a higher thermal conductivity, e.g. aluminium, another metal or another material which facilitates reflection of heat radiation, and this material may be treated to have a highly polished reflective surface to facilitate enhanced reflection of the radiated heat, since the inner reflector(s) preferably do not get into range to be touched by persons or their clothing, since they are surrounded by the casing 2.

In an embodiment of the invention, the heat shielding means 4 is/are attached to the inner reflecting screen(s) 11 and/or the casing 2 by means of screws, blind rivets, an adhesive, latch and notch adapted for receiving the latch, by being wedged or the like. The heat shielding means may in an embodiment of the invention also be an integrated part of the heat housing 2.

In a preferred embodiment of the invention, the diameter dl of the housing 2 of the heating apparatus 1 is less than 40 cm, such as less than 25 cm, e.g. less than 17 cm. Hereby, the heating apparatus 1 is very compact and is advantageous to arrange underneath a table. Likewise, the heating apparatus 1 hereby is advantageous for supporting a table top 9, e.g. substantially in the center of a round café table, since the heating apparatus 1 hereby still leaves room for legs of persons sitting around the table.

The distance dist. 1 from the heat source 3 to the heat shielding means 4 is preferably less than 20 cm, such as less than 13 cm, e.g. no more than ca. 8 cm.

In an embodiment of the invention, the heat source 3 is connected to an inner part (not illustrated) which may be horizontally and/or vertically displaceable to allow easy service and replacement of the heat source 3.

Figure 4:
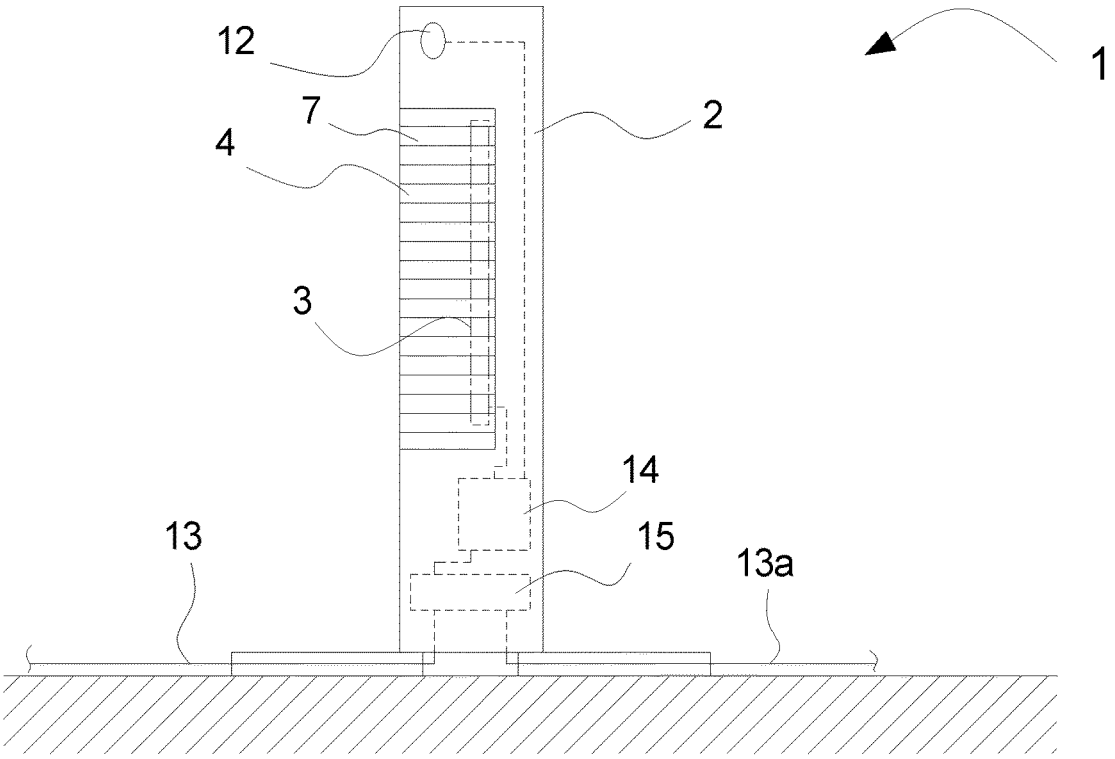
FIG. 4 illustrates an embodiment of the heating apparatus comprising control means.

FIG. 4 illustrates the heating apparatus 1 seen from the side. The heating apparatus is supplied with electrical power by means of electrical supply means 13, e.g. a wire, which supplies the electrically powered heat source 3, control means 14, movement sensor and the like. The heating apparatus 1 comprises power connection means 15 facilitating connection of the electrical supply means 13 to the heating apparatus 1.

In an embodiment of the invention, the heating apparatus 1 comprises energy storage means (not illustrated), and is at least partly powered by these energy storage means. Such energy storage means may e.g. be one or more (e.g. rechargeable) batteries (not illustrated in any drawings). The battery or batteries may be recharged when the heat source is connected to a power source by means of the electrical supply means 13 (and/or 13*a*), and when the electrical supply means 13 (or 13*a*) are disconnected, the heating apparatus may switch to supply the heat source 3 by means of the one or more batteries. Other examples of energy storage means may be fuel cells such as e.g. PEM (Proton Exchange Membrane) cells, DMF (Direct Methanol Fuel) cells or any other suitable energy storage means known to a person skilled in the art.

In a preferred embodiment of the invention, the heating apparatus 1 facilitates electrical power supply of other heating apparatuses 1 by facilitating connection of electrical power supply means 13*a*. This may be achieved by means of the power connection means 15 comprising means for connection of more than one electrical supply means 13, 13*a*.

In an embodiment of the invention, the electric components of the heating apparatus 1, such as circuit board(s), power supplies, sensor means 12 (described in more details below), the control means 14 and the like is/are arranged in the lower part of the housing 2, preferably below the electrically powered heat source 3 to avoid unnecessary heating of the electronic components. This is advantageous in that conventional electric components are not designed to and/or capable of resisting the temperature that may occur inside the middle/upper part of the housing 2, e.g. due to the waste heat from the electrically powered heat source 3.

It is further understood that the heat source 3 and/or the (e.g. rechargeable) energy storing means may be at least partly supplied by renewable energy means (not illustrated) such as solar power (e.g. solar cells), wind energy or the like to facilitate a further environmental friendly heating apparatus. The renewable energy means may be arranged at the heating apparatus (e.g. on and/or in the table top), on the housing or near to the heating apparatus 1 (e.g. on a wind screen).

The power connection means 15 may comprise one or more sockets adapted for receiving plugs of the electrical supply means 13, 13*a*, it may comprise screw terminal board(s) or any other suitable connection means.

In an embodiment of the invention, the heating apparatus may comprise additional electrical power connection means (not illustrated), e.g. a socket adapted for receiving a plug for connecting electrical consumer products e.g. heating plates for heating food, lamps, or other electrical consumer products.

In an embodiment of the invention, the heating apparatus 1 comprises one or more sensor means 12 for detecting the presence of one or more persons arranged near or around the heating apparatus 1, e.g. proximity sensor(s) and/or movement sensors. By the term proximity sensor is to be understood a sensor which is able to detect the presence of nearby objects without any physical contact. Such sensor means 12 may be capacitive sensor(s), PIR (Passive InfraRed) sensor(s), optical sensor(s) such as photoelectric sensor(s), or any other suitable sensor(s) known to a person skilled in the art. The heat source(s) 3 of the heating apparatus 1 may hereby be controlled to be automatically turned on when a person is present and off when a person is not present, thereby saving energy.

In an embodiment of the invention, the heating apparatus 1 comprises timer means to facilitate that when the heat source (3) is turned on, it will stay on for a predetermined amount of time. The timer means may be activated by the sensor means 12 for detecting the presence of one or more persons arranged near or around the heating apparatus 2 as described above, or by other means for turning the heat source(s) 3 on, e.g. a button arranged on the heating apparatus, on a table top, remote to the heating apparatus 1 or the like.

In an embodiment of the invention, the heating apparatus 1 may be wirelessly controlled by a remote control, a mobile phone or the like by means of e.g. Bluetooth, WLAN, a GSM network or the like.

Figure 5:
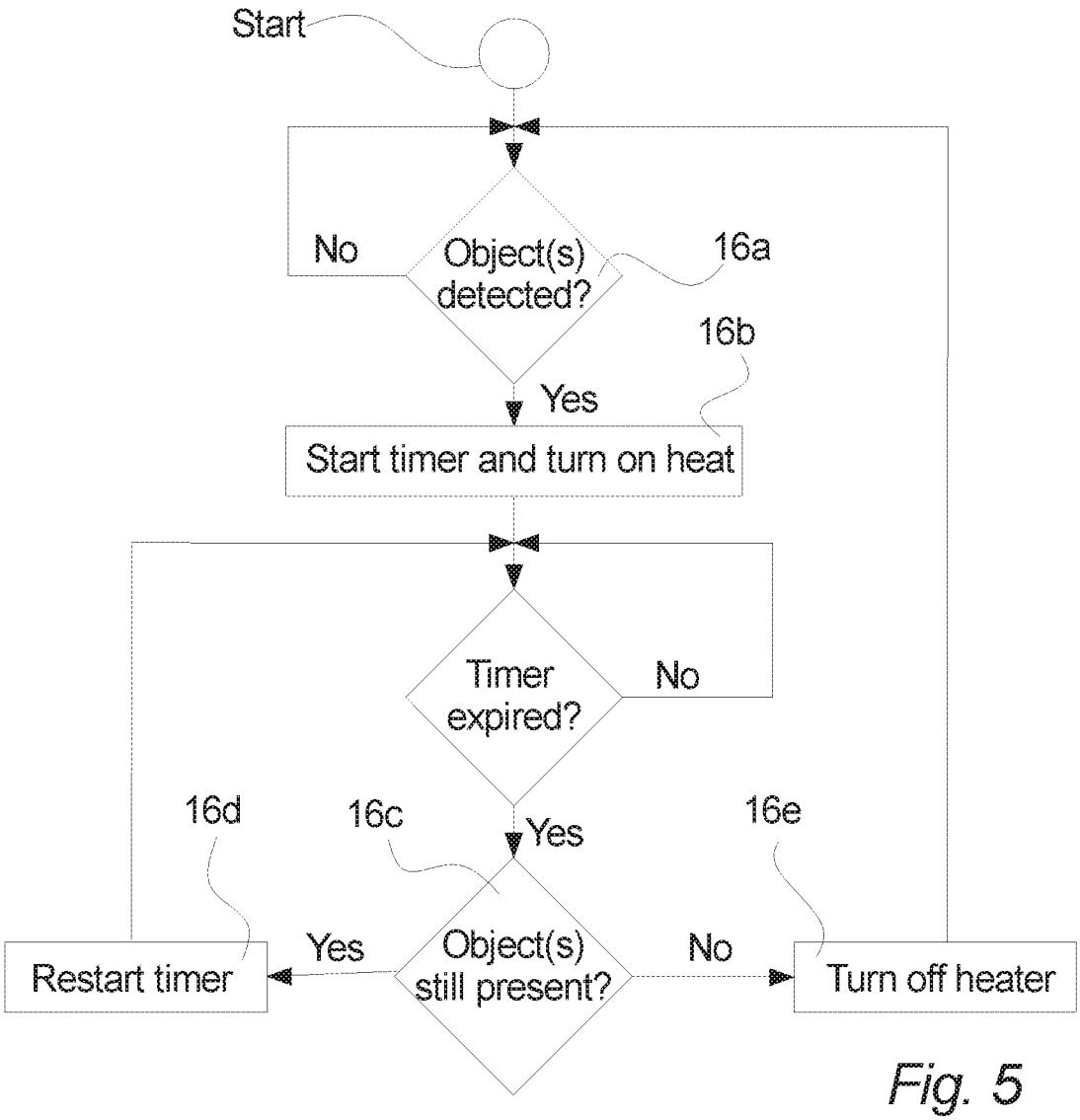
FIGS. 5-7 illustrate embodiments of flow charts and tables of the control means.

FIG. 5 illustrates an example of an embodiment of a flow chart of the control means 14 comprising data processing means.

The control means 14 detects in step 16*a* if one or more persons (objects) are present near the heating apparatus 1 by means of the sensor means 12. If a person is detected a timer is started and the heat source 3 is turned on in step 16*b*. After the expiry of a preset time the heating apparatus again detects if an object is present in step 16*c*, and if an object is detected the timer is restarted in step 16*d* and the heat source 3 is kept turned on. On the other hand, if no object is detected the heat source 3 is turned off in step 16*e*, and the heating apparatus 1 again starts to detect if persons are present in step 16*a*.

It is of cause understood that the control means 14 may also instead or additionally perform detection of the presence of persons continuously during the countdown/up of the timer, and every time a person is detected the timer may be restarted. The heat source 3 is in this embodiment turned off when the timer expires.

Figures 6, 7:
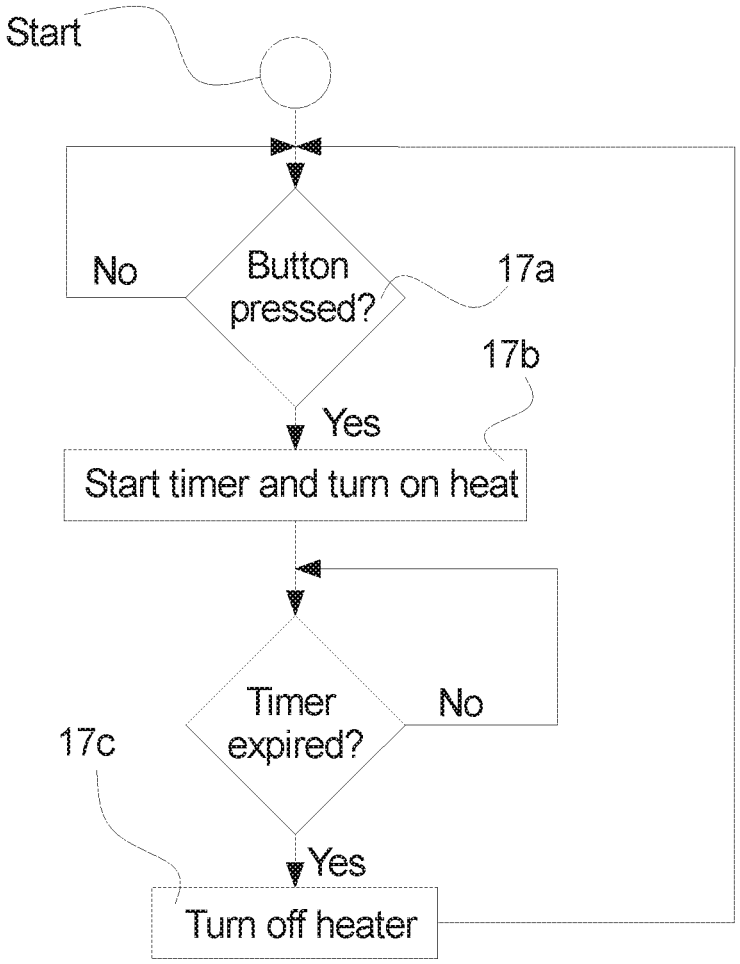

FIG. 6 illustrates another example of an embodiment of a flow chart of the control means 14 comprising data processing means. In this embodiment the control means 14 in step 17*a* detects if a button on the heating apparatus 1 is activated. If the button is activated, the heat source 3 is in step 17*b* turned on and a timer is started. After the expiry of a preset time the heat source is in step 17*c* turned off and the button may be pressed to turn on the heat source 3 again.

The heating apparatus 1 may in an embodiment of the invention comprise a clock to facilitate that the heating apparatus 1 may only be turned on within a predetermined time span, e.g. only in the opening hours of a restaurant or the like.

In a further embodiment of the invention, the heating apparatus 1 may comprise temperature measuring means to measure the temperature of the ambient air, to facilitate that the heating apparatus 1 may only be turned on when the temperature of the ambient air is below a predetermined level.

It is understood that any combination of input signal(s) from timer(s), clock, sensor means 12, temperature measuring means, buttons and the like may be used by the control means 14 to control the heat source 3 and/or the like.

Figure 8:
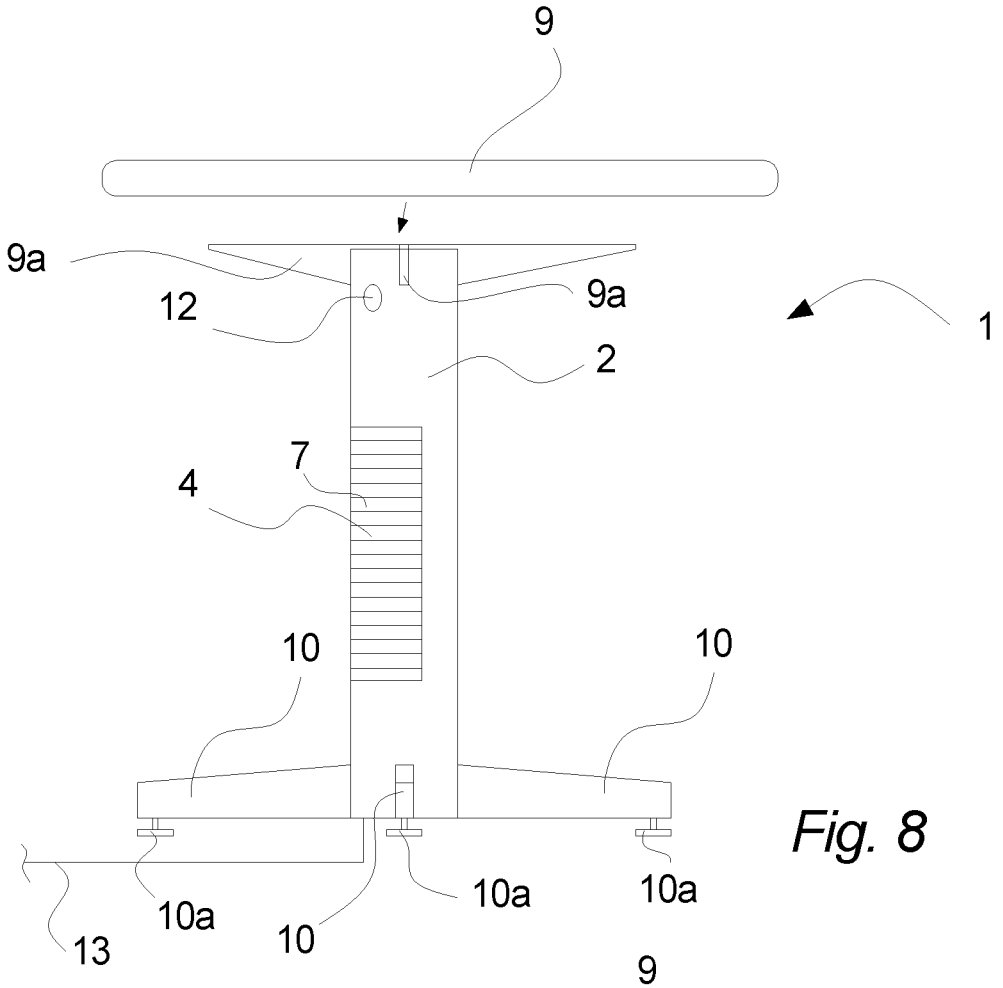
FIGS. 8 and 9 illustrate an embodiment of the heating apparatus facilitating support of a table top.

The control means 14 may in an embodiment of the invention be adapted to control the heat source(s) 3 of other heating apparatuses 1, e.g. by controlling the electrical supply to other heating apparatuses powered by supply means 13*a* from the heating apparatus, e.g. as illustrated in FIG. 8. Hereby, it is possible to reduce the costs of heating apparatuses since one heating apparatus 1 may comprise control means 14, sensor means 12, buttons, timers etc, and the others only need the heat source 3.

In an embodiment of the invention, the heating apparatus 1 comprises means for controlling the electrically powered heat source 3 by heat regulation means (not illustrated in any figures) to a value below its rated power. Thereby, it is possible to adapt the heat source 3 to emit the necessary/wanted amount of heat. E.g. a 500 W heat source 3 may be controlled by the persons around the table or other persons to produce heat corresponding to e.g. between 200 W and 500 W which may be sufficient dependent on the outside temperature. The heat regulation may also be achieved at least partly automatically by the control means 14, e.g. based on a measured temperature.

FIG. 7 shows other examples of how the data processing means of the control means 14 may process data. In the example, the time from turning on the heat source 3 and the temperature of the ambient air of the heating apparatus 1 is used, but it is of cause understood that other parameters may be used. When the heat source 3 is turned on (e.g. as a response to an input signal from sensor means 12) and the ambient temperature is below e.g. 14° C., the heat source 3 may be controlled to emit 100% of its rated power. This may be advantageous since persons who have just arranged themselves around the table may need more heat to get warm. When the heat source 3 has been on for e.g. 5 minutes, the heat source 3 may automatically be adjusted to emit 70% of its rated power since the persons are probably now warm enough. If the ambient temperature drops further, the heat source 3 may be controlled to emit more of its rated power, e.g. by being adjusted from emitting 70% to emit 80% of its rated power.

FIG. 8 illustrates an embodiment of the heating apparatus seen from the side. In this embodiment, the heating apparatus 1 is configured for supporting a table top 9. The heating apparatus 1 preferably comprises support means 9*a* for supporting the table top 9, and support means 10 to facilitate a more secure support of the heating apparatus 1 and the table top 9. The support means 10 may comprise adjustable parts 10*a* which is at least vertically adjustable, e.g. by one or more screws to facilitate that the heating apparatus 1 may be adjusted to prevent wobbling of the heating apparatus 1 and the table top 9 if the heating apparatus facilitates support of a table top 9.

Figure 9:
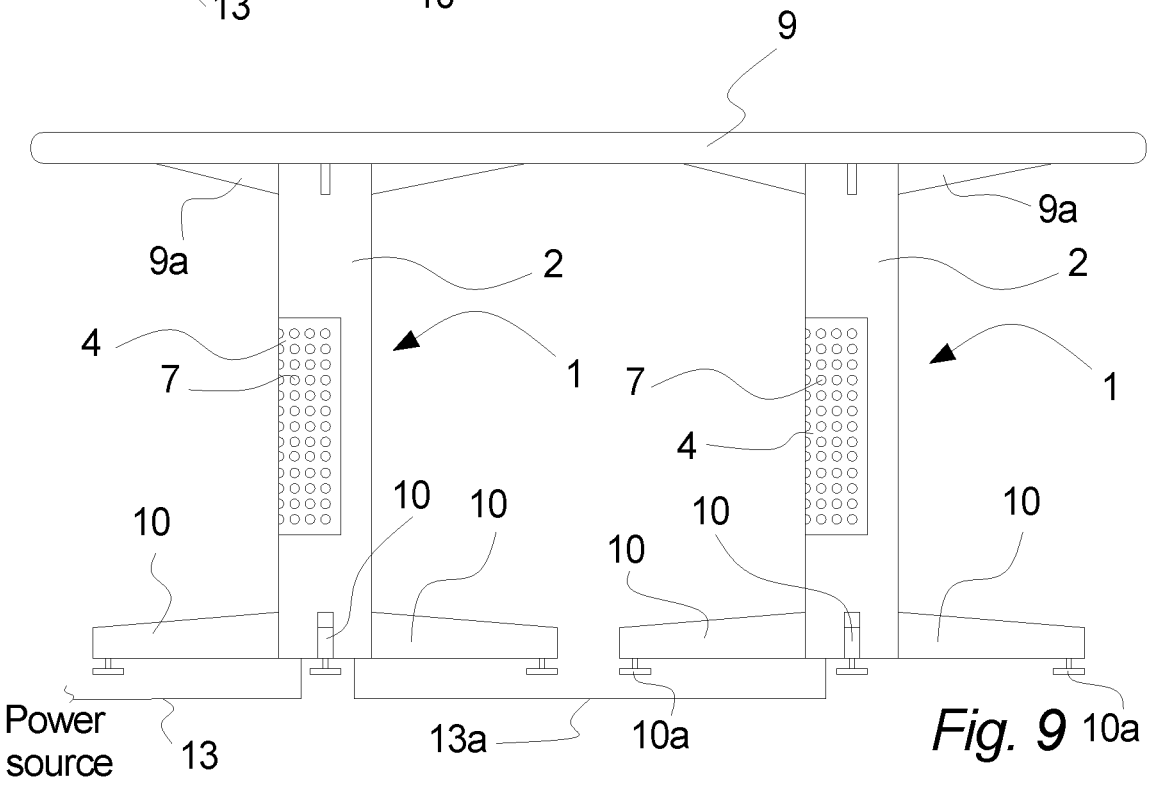

FIG. 9 illustrates an embodiment of the invention wherein two heating apparatuses 1 comprise support means 9*a* for supporting a larger table top 9. As illustrated in this embodiment and as described earlier, one heating apparatus 1 supplied with electrical power from a power source by electrical supply means 13, may supply another heating apparatus 1 with power by means of electrical supply means 13*a* for supplying another heating apparatus 1 with electrical power.

In an embodiment of the invention, the heating apparatus 1 may have a height which is suitable to fit under most tables. If the heating apparatus 1 is wished to act as support for a table top, support means 10 may be applied to facilitate a more secure support of the heating apparatus 1 and the table top 9, and to elevate the heating apparatus 1 to have a suitable height for supporting a table top 9. Alternatively, the heating apparatus may comprise an insertion part (not illustrated in any drawings) to facilitate support of a table top 9, the insertion part being configured for insertion between the table top 9 and the heating apparatus 1 to elevate the table top 9 to have a suitable height. Likewise, the table top also acts a shielding of the heating apparatus against rain, snow and the like.

It is preferred that the heating apparatus 1 lives up to safety regulations regarding electrical safety to assure that persons directly or indirectly touching the heating apparatus is not exposed to electrical shock.

Figure 10:
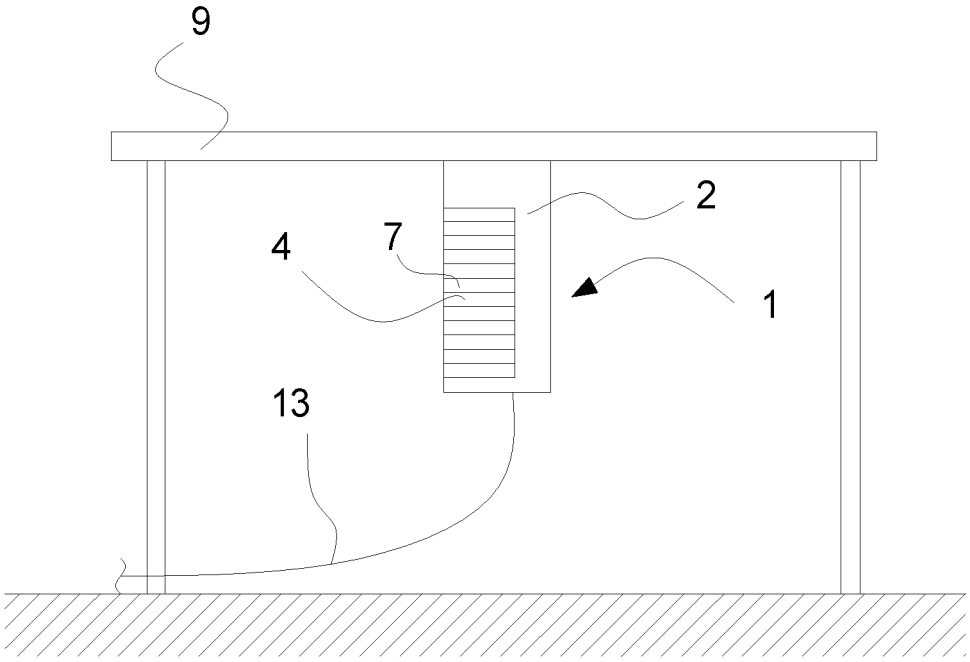
FIG. 10 illustrates an embodiment of the heating apparatus attached to the under surface of a table top without touching the ground.

FIG. 10 illustrates another embodiment of the invention wherein the electrical heating apparatus (1) is configured for being attached to the undersurface of a table top 9 without touching the ground. In the embodiment illustrated in FIG. 10, the heating apparatus is arranged vertically as it preferably is when it e.g. is adapted for supporting a table top, but the heating apparatus 1 may also in other embodiments be tuned about 90° around a horizontal axis and be attached to the under surface of the table top 9 to take up less space in the vertical direction under the table.

The heating apparatus 1 may in a further embodiment, which is not illustrated, be configured for being attached to a wall.

Figure 11:
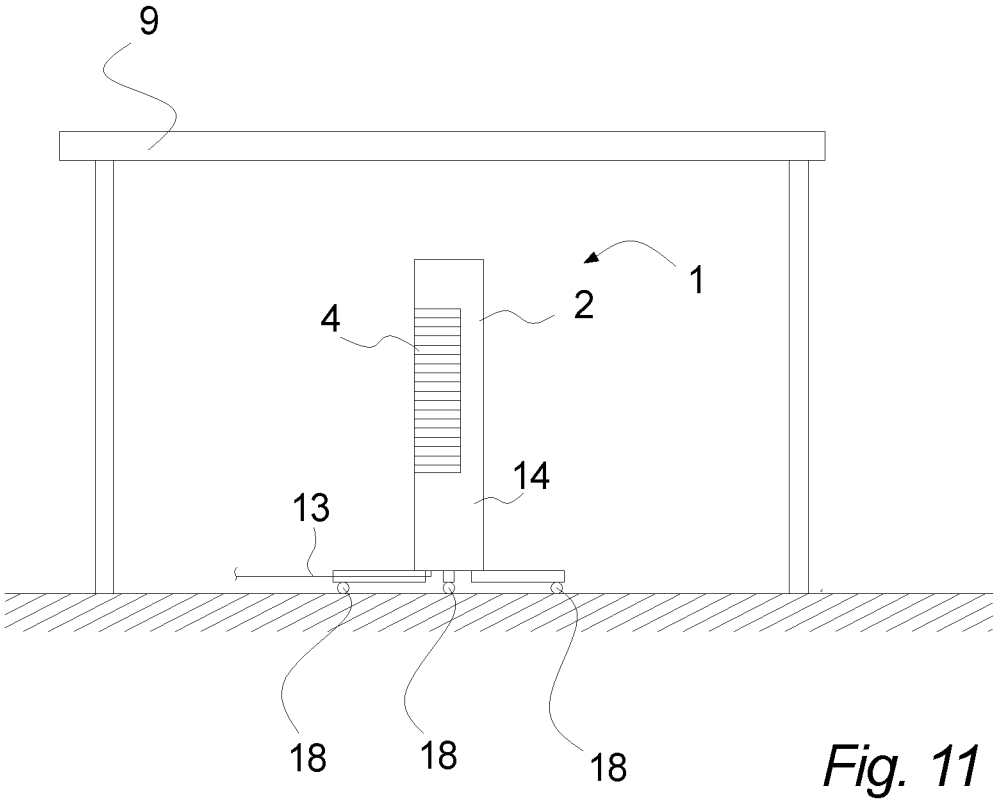
FIG. 11 illustrates the heating apparatus according to the invention, arranged underneath a table.

FIG. 11 illustrates an embodiment of the heating apparatus 1 arranged underneath a table. It is understood that the heating apparatus 1 may comprise wheels 18 to ease the moving of the heating apparatus 1.

FIGS. 12, 12*a*, 12*b* and 12*c* illustrate a further embodiment of the invention where a flow of air inside the hosing 2 can be achieved. The heat source 3 may generate waste heat which may unintentionally raise the temperature of the outer surface of the housing 2, especially if the housing is made of a material with good thermal conductivity e.g. a metal, such as aluminium, steel or the like. Likewise, the housing 2 may unintentionally absorb some of the heat radiation, and thereby get heated.

Therefore, it is advantageous to supply the housing 2 of the heating apparatus 1 with with one or more inlets 19*a*, and one or more outlets 19*b*, to facilitate a flow of air inside the housing 2. The inlet(s) 19*a* and/or the outlets (19*b*) may in an embodiment of the invention be achieved by one or more through holes 20*a*, 20*b*

The flow of air will help to remove waste heat from the heat source 3 preferably by means of the stack effect/chimney effect. The air is sucked from the outside of the housing through the through holes 19*a* in the lower part of the housing 2, into the inside of the housing 2, past the heat source 3, and out of the through holes 19*b* in the upper part of the housing. Thereby, the air inside the housing 2, and/or the housing 2 itself is cooled to lower the surface temperature of the housing 2 to an advantageous lower level. Likewise, the waste heat leaving the upper part of the heating apparatus 1 may in embodiments of the invention help to heat up persons sitting/arranged around the heating apparatus 1.

In a further embodiment of the invention which is not illustrated in any figure, the heating apparatus 1 comprises cooling fins inside the housing e.g. as a part of the structure supporting and/or surrounding the heat source 3, to enhance the chimney effect of the heating apparatus 1 and/or to enhance cooling of components inside the housing 2.

It is understood that the flow of air may also in another embodiment of the invention be achieved by other means suitable to achieve a flow as explained above, e.g. by a ventilator which in an embodiment of the invention may be controlled by the control means 14 e.g. to be turned on when sensor means 12 detect that persons are present, be controlled by a thermostat measuring the temperature of the housing 2, or the like.

The ventilator may also in an embodiment of the invention which is not illustrated create the flow downwardly and out of the lower part of the heating apparatus 1, which may cause that persons arranged around the heating apparatus 1 may get their feet heated by the waste heat.

The flow of air may likewise be achieved by the stack effect, and be assisted by the above mentioned means suitable to achieve a flow.

Figure 12:
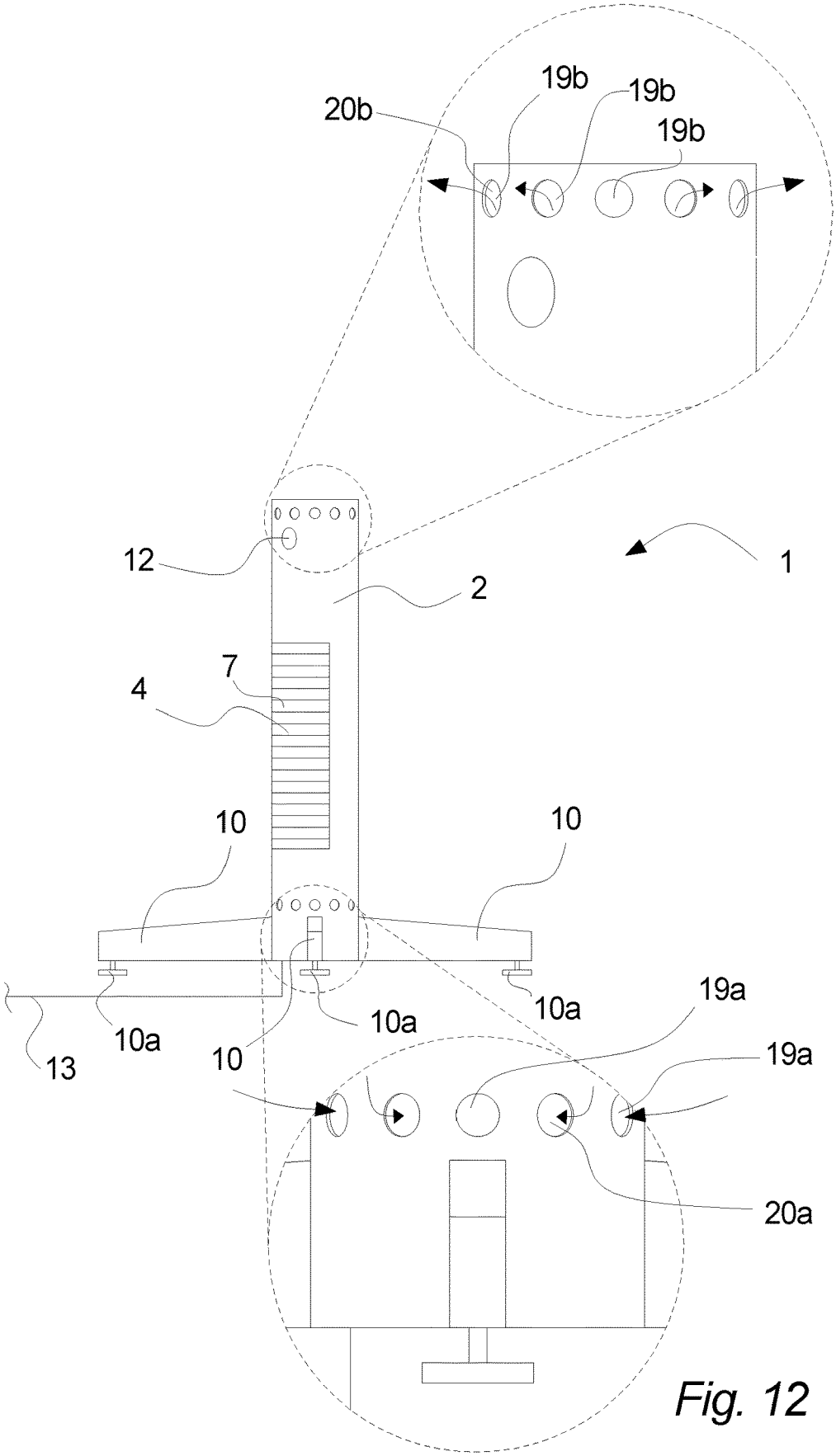
FIG. 12 illustrates an embodiment of the invention where a flow of air inside the housing can be achieved.
Figure 12A:
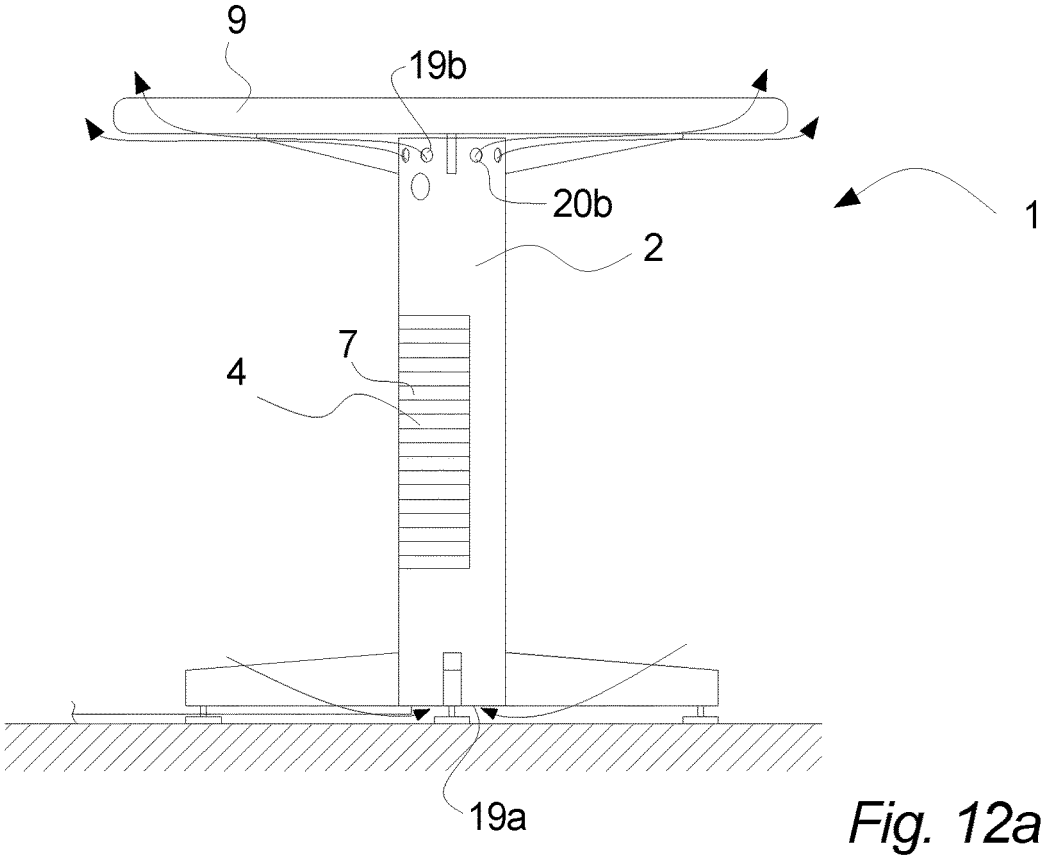
FIGS. 12*a*-12*c* illustrate embodiments of the invention where a flow of air inside the housing 2 can be achieved.

FIG. 12*a* illustrates another embodiment of the invention, wherein the housing 2 comprises through going outlet holes 19*b* in the upper part of the housing 2, and where the lower end of the heating apparatus comprises an opening which may be used as inlet 19*a* for the air. This may be advantageous since it is thereby not necessary to make holes in the housing 2, and since a natural opening in the housing 2 (e.g. if the housing is made of a bended or welded plate, a pipe or the like) may be used as inlet for the air.

Figure 12B:
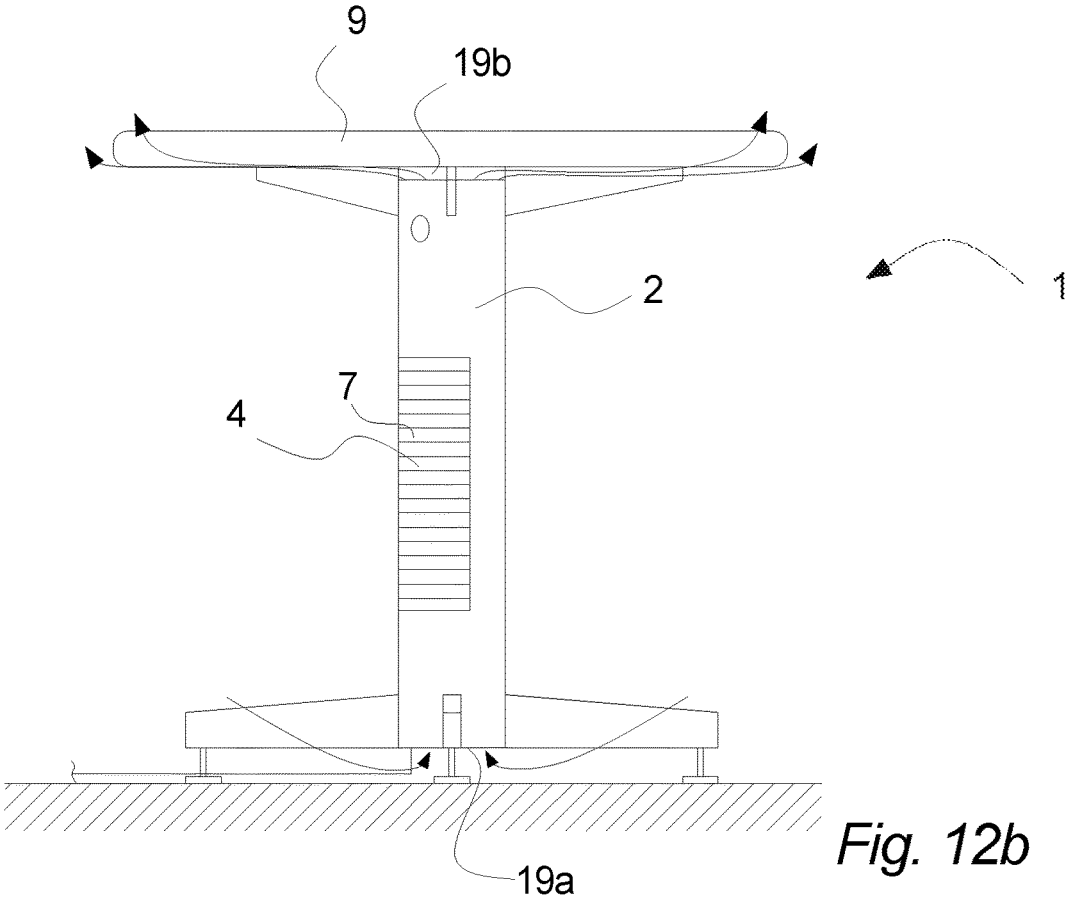

FIG. 12*b* illustrates a further embodiment of the invention wherein the lower end of the heating apparatus 1 is used as inlet 19*a* of the air, and the upper end is used as an outlet 19*b* for the air. If the heating apparatus 1 supports a table top 9 (e.g. as illustrated in FIGS. 12*a* and 12*b*), the table top 9 may be arranged with a small vertical distance to the heating apparatus 9, to allow that the heat can be let out of the upper end 20*b* of the heating apparatus 1.

Figure 12C:
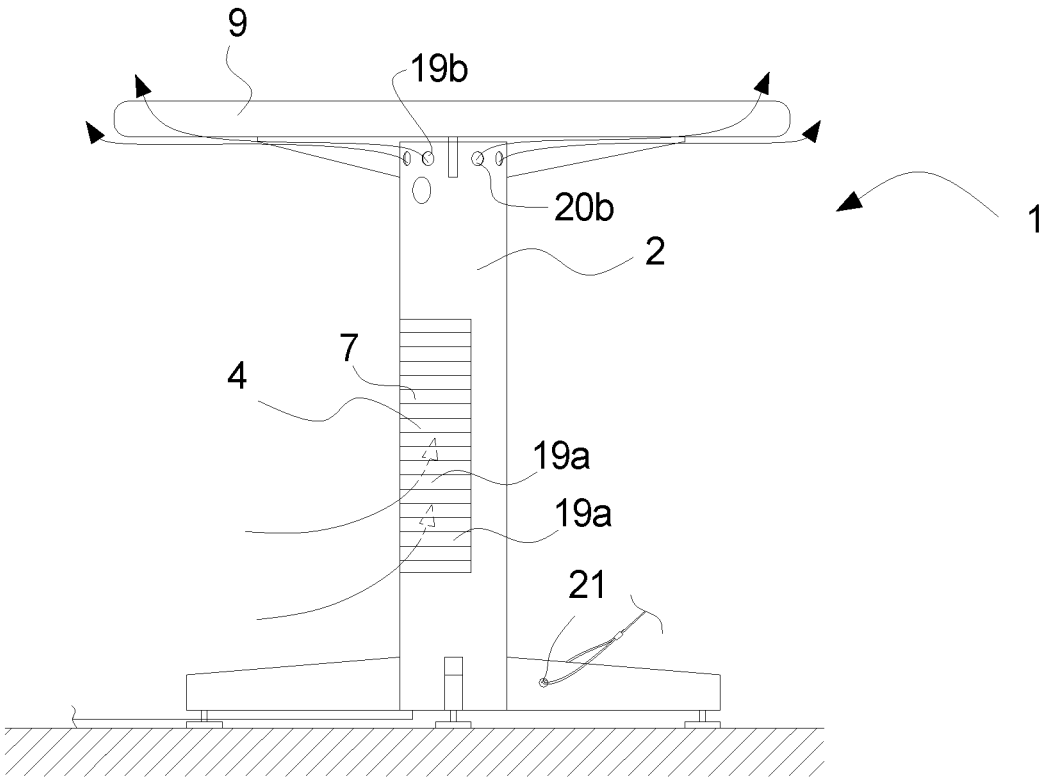

FIG. 12*c* illustrates a further advantageous embodiment of the invention wherein the heat shielding means 4 is/are used as inlet 19*a* for the flow of air. This is advantageous in that the heat shielding means 4 may be naturally cooled by the flow from the outside of the housing 2 through the openings/through holes 7 of the heat shielding means 4.

It is of cause understood that any combination of the embodiments of the inlets 19*a* and outlets 19*b* to allow/achieve a flow of air inside the housing 2 e.g. described in relation to any of the figures FIG. 12-12*c* may be used.

FIG. 12*c* illustrates a further embodiment of the invention which also may be used in any other embodiment of the invention. In this embodiment of the invention the heating apparatus comprises anti-theft protection means 21. In this figure the anti-theft protection means 21 comprises one (or more) fastening means such as a hole in the support structure of the heating apparatus 1, a ring/mounting secured to the support structure which is suitable for fastening a wire or a chain. This wire/chain may be connected to other heating apparatuses, a hinge/mounting in the ground, on a building or the like. Other anti-theft protection means 21 which are not illustrated may be a positioning device such as GPS (Global Positioning System) means suitable of informing a user about the position of the GPS means and hereby the heating apparatus 1, it may be an acoustic and/or visual alarm or the like.

It should be understood that the invention is not limited to the particular examples described above but may be designed and altered in a multitude of varieties within the scope of the invention.

The invention claimed is:

1. An electrical heating apparatus for arranging under a table, said heating apparatus comprising:

a housing configured for preventing heat radiation through the housing at one or more angular sections around a vertical axis, at least one electrically powered heat source arranged inside said housing, heat shielding means comprised in the housing and having a plurality of through holes configured for allowing heat radiation from the electrically powered heat source to pass, wherein the heat shielding means comprises a layer of a material with a thermal conductivity lower than 2 $[W \cdot m^{-1} \cdot K^{-1}]$, and wherein an inner surface of the heat shielding means is applied with a layer of heat radiation reflecting material configured for reflecting the heat radiated from the heat source back against an inner part of the housing, and one or more inner heat radiation reflecting screens arranged inside said housing and being configured for reflecting heat radiation towards the heat shielding means and for allowing heat emission from two predetermined angular sections of the heating apparatus, the two angular sections being substantial opposite to each other in the housing.

2. The electrical heating apparatus according to claim 1, wherein the at least one electrically powered heat source is of a rated power between 100 W and 700 W.

3. The electrical heating apparatus according to claim 1, wherein said layer of a material with a thermal conductivity lower than 2 $[W \cdot m^{-1} \cdot K^{-1}]$ has a thermal conductivity lower than 0.5 $[W \cdot m^{-1} \cdot K^{-1}]$.

4. The electrical heating apparatus according to claim 1, wherein said electrical heating apparatus comprises power connection means configured for power supply of one or more further heating apparatuses.

5. The electrical heating apparatus according to claim 1, wherein said electrical heating apparatus facilitates support of a table top.

6. The electrical heating apparatus according to claim 1, wherein said electrical heating apparatus is configured for being attached to the under surface of a table top without touching ground.

7. The electrical heating apparatus according to claim 1, wherein said electrical heating apparatus comprises sensor means configured for detecting the presence of one or more persons around the heating apparatus, and control means configured for controlling the heat source based on signals from said sensor means.

8. The electrical heating apparatus according to claim 1, comprising data processing means for controlling the electrically powered heat source, wherein the data processing means facilitates regulation of the at least one electrically powered heat source to a value below its rated power.

9. The electrical heating apparatus according to claim 1, wherein said heat shielding means during operation will not be heated to a temperature above 50° C.

10. The electrical heating apparatus according to claim 1, wherein said housing has a diameter of no more than 0.3 meters.

11. The electrical heating apparatus according to claim 1, wherein said layer of heat radiation reflecting material has a reflection coefficient ρ of infrared radiation in the range of 0.6 to 1.

12. The electrical heating apparatus according to claim 1, wherein said housing and said heat shielding means together forms a substantially circular shaped heating apparatus seen from above.

13. The electrical heating apparatus according to claim 1, wherein said heating apparatus is adapted to facilitate a flow of air from the outside of the housing, through one or more inlets into the housing, through the inside of the housing, and out through one or more outlets of the housing.

14. The electrical heating apparatus according to claim 13, wherein the said inlet(s) and outlet(s) are arranged to facilitate that the flow of air is driven by a stack effect.

15. The electrical heating apparatus according to claim 13, wherein said outlet(s) are arranged at an upper part of the heating apparatus.

16. The electrical heating apparatus according to claim 13, wherein said inlet(s) and said outlet(s) comprises one or more through holes in the side of the housing.

17. The electrical heating apparatus according to claim 13, wherein said inlet(s) are the plurality of through holes of the heat shielding means.

* * * * *